United States Patent [19]

Ziegler et al.

[11] 4,031,425

[45] June 21, 1977

[54] DISPENSER CATHODE FOR A GRID-CONTROLLED ELECTRON TUBE AND METHOD OF MANUFACTURING SAME

[75] Inventors: Reinhard Ziegler; Horst Seifert, both of Hamburg, Germany

[73] Assignee: U.S. Philips Corporation, New York, N.Y.

[22] Filed: Oct. 2, 1975

[21] Appl. No.: 619,061

[30] Foreign Application Priority Data

Oct. 19, 1974 Germany ..... 2449796

[52] U.S. Cl. ..... 313/346 R; 313/304; 313/338; 313/346 DC

[51] Int. Cl.[2] ..... H01J 1/14; H01J 19/06; H01K 1/04

[58] Field of Search ..... 313/338, 348, 346 DC, 313/302, 304, 346; 315/3.5

[56] References Cited

UNITED STATES PATENTS

| | | | |
|---|---|---|---|
| 2,782,334 | 2/1957 | Gardner | 313/338 X |
| 3,119,041 | 1/1964 | Harris | 313/338 X |
| 3,377,492 | 4/1968 | Oess | 313/348 |
| 3,402,314 | 9/1968 | Vlaardingerbroek et al. | 313/348 |
| 3,500,110 | 3/1970 | Winsor | 315/3.5 |
| 3,558,967 | 1/1971 | Miriam | 315/3.5 |
| 3,648,096 | 3/1972 | Beggs | 313/348 |
| 3,818,260 | 6/1974 | Elfe, Jr. et al. | 313/338 |
| 3,843,902 | 10/1974 | Miriam et al. | 313/348 |

*Primary Examiner*—Saxfield Chatmon, Jr.
*Attorney, Agent, or Firm*—Frank R. Trifari; Carl P. Steinhauser

[57] ABSTRACT

A dispenser cathode for a grid-controlled electron tube in which the emission of surface regions immediately opposite the control grid is reduced by providing projections above the emissive surface of fused, pore-closing portons which have a focussing effect. These projections may be formed by electron beam or laser beam welding.

8 Claims, 2 Drawing Figures

Figure 1:
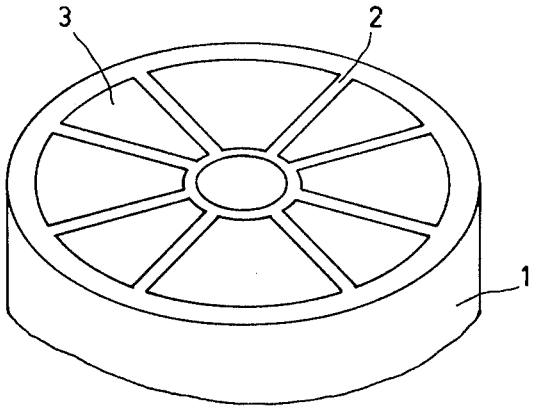

DISPENSER CATHODE FOR A GRID-CONTROLLED ELECTRON TUBE AND METHOD OF MANUFACTURING SAME

The invention relates to a sintered dispenser cathode for a grid-controlled electron tube in which the emission of the surface regions of the emissive surface of the cathode immediately opposite to the control grid is reduced. The invention relates also to methods of manufacturing such a cathode.

In density-controlled tubes (triodes, tetrodes) it is desired, and in travelling wave tubes (klystrons, TWT) it is even necessary, for increasing the efficiency that the control grid obtains a positive voltage relative to the cathode. The value of the positive voltage is restricted by the admissible grid dissipation because an important component of said dissipation is caused by the grid direct current in the case of a positive grid voltage. Said dissipation limit is reached the sooner according as the operating frequency is higher and the distance between the grid and the cathode is smaller. Various measures have already been used to reduce or avoid the grid current in the case of a positive grid voltage.

In oxide cathodes it is known, for example, not to cover the surface regions of the cathode present directly opposite to the grid with emission paste. The cathode may be constructed so that the non-emissive stripes project above the emission surface of the cathode in such manner that a focusing effect is formed at the side faces of said stripes extending at right angles to the cathode surface by the field lines terminating at right angles, so that the electrons emerging from the emissive part of the cathode surface are focused (Candy stripe cathode) and hence pass through the grid apertures.

It is furthermore known (see German published patent application No. 2,029,675) to provide a shadow grid between the control grid and the cathode, said shadow grid being at cathode potential and screening the cathode parts present opposite the control grid. In this case also the electron current is focused by the side faces of the shadow grid.

The manufacture of such a cathode having a shadow grid, however, is very complicated, in particular when it is a sintered concave dispenser cathode. When the cathode is provided for a klystron tube operating at very high frequencies, the solution using the shadow grid does not give good satisfaction already due to the very small distances required in the said case.

It is therefore an object of the invention in sintered dispenser cathodes having small grid-cathode distances, to avoid as much as possible the grid current with a positive driving of the grid in the simplest possible manner.

Another object of the invention is to enable the grid current restriction also in concave sintered dispenser cathodes.

According to the invention this is achieved in a dispenser cathode of the kind mentioned in the preamble in that the surface regions of reduced emission are constructed as projections of the cathode body having a focusing effect.

As a result of this it is possible to omit the use of a special shadow grid or other parts to be connected to the cathode body.

Such a dispenser cathode can be manufactured according to the invention in that the projections are formed by an emission-reducing fusion of the said surface regions of the cathode. Said fusion may be carried out, for example, by means of an electron beam, an ion beam or a laser beam.

A further method of manufacturing a dispenser cathode according to the invention consists in that the projections of reduced emission are formed in that the surface regions of the emissive surface of the cathode present opposite to the grid apertures are deepened by a material-removing process and the projecting surface regions thus formed are passivated. The removal of the material may be carried out by spark erosion or by photoetching, and passivating the projecting surface regions of the projections may be carried out by fusion by means of an electron beam or a laser beam. It is also possible to sinter the cathode body already with projections, which projections can then be passivated, for example, by means of any of the said methods.

Figure 2:
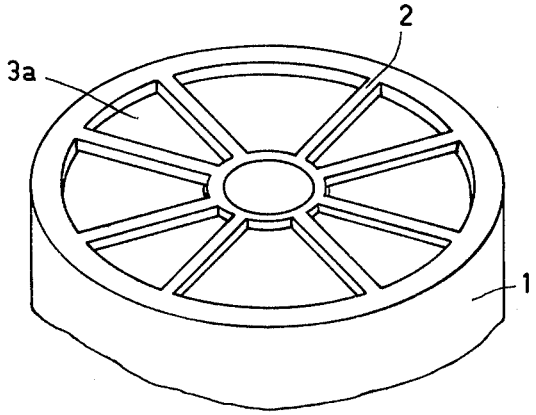

The invention will now be described with reference to the accompanying drawing, in which FIG. 1 shows a first embodiment of a dispenser cathode, and FIG. 2 shows a second embodiment of a dispenser cathode.

FIG. 1 is a sectional view of the cathode body 1 of a first embodiment of a dispenser cathode according to the invention. On the slightly concave emission surface 3 of the cathode the surface regions 2 present opposite to the control grid wires (not shown) are reduced in emission and constructed so as to form projections having a focusing effect. This can simply be obtained in that the corresponding surface regions 2 are fused by means of an electron beam of a laser beam. As a result of this the pores of the cathode surface are closed so that the emission is reduced, while simultaneously, as a result of the fusion, fusion surfaces and hence projections are formed which have a focusing effect.

As is shown in the embodiment of FIG. 2, the focusing effect of the passivated parts of the cathode surface can be increased in that the active-remaining-surface regions 3*a* of the emissive surface of the cathode which are present opposite to the grid apertures are deepened by a material-removing process. This may preferably be carried out by means of the spark erosion method with which it is possible to realize also a comparatively complicated variation of the projections 2 which as a matter of fact should correspond to the wires of the control grid.

The surfaces of the projections are then passivated again by fusion by means of an electron beam or a laser beam.

It is also possible to manufacture the cathode body with projections shown in FIG. 2 as one assembly by sintering and then passivating the surface regions of the projections.

What is claimed is:

1. A sintered dispenser cathode for a grid-controlled electron tube in which the emission of regions of the emissive surface of the cathode immediately opposite to the control grid is reduced, said cathode having projections above the emissive surface of fused pore-closed portions of reduced emission which have a focusing effect.

2. A sintered dispenser cathode as claimed in claim 1, wherein the dispenser cathode has a concave emissive surface.

3. In the method of manufacturing a dispenser cathode for a grid-controlled electron tube in which the emission of surface regions of the emissive surface immediately opposite the grid is reduced, the improvement wherein surface regions of the cathode are fused to close pores and form non-emissive projections.

4. A method as claimed in claim 3, wherein the fusion is carried out by means of an electron beam or a laser beam.

5. A method of manufacturing a dispenser cathode as claimed in claim 3, wherein after the projections of reduced emission are formed, the surface regions of the emissive surface of the cathode between the projections are deepened by a material-removing process and the projecting surface regions are thereafter passivated.

6. A method as claimed in claim 5, wherein the material of the surface regions between the projections is removed by spark erosion.

7. A method of manufacturing a dispenser cathode as claimed in claim 3, wherein the cathode body is formed with projecting surface regions which are passivated.

8. A method as claimed in claim 7, wherein the projecting surface regions of the projections are passivated by fusion by means of an electron beam, an ion beam or a laser beam.

* * * * *